United States Patent [19]

Cook

[11] Patent Number: 4,672,910

[45] Date of Patent: Jun. 16, 1987

[54] ADJUSTABLE STRAP

[76] Inventor: Douglas C. Cook, 5600 Cresthaven La., Toledo, Ohio 43614

[21] Appl. No.: 787,301

[22] Filed: Oct. 15, 1985

[51] Int. Cl.[4] ..... B63B 17/00

[52] U.S. Cl. ..... 114/361; 114/343; 24/306; 150/52 K

[58] Field of Search ..... 114/361, 343, 364; 24/306, 442, 183, 200, 265 B; 296/98, 136; 150/52 K; 441/38

[56] References Cited

U.S. PATENT DOCUMENTS

| | | | |
|---|---|---|---|
| 1,472,651 | 10/1923 | Holling | 150/52 K |
| 2,821,989 | 2/1958 | Shepard | 114/361 |
| 3,500,483 | 3/1970 | Schohn | 114/364 |
| 3,947,927 | 4/1976 | Rosenthal | 24/306 |
| 4,091,484 | 5/1978 | Means | 114/361 |

*Primary Examiner*—Joseph F. Peters, Jr.
*Assistant Examiner*—Paul E. Salmon
*Attorney, Agent, or Firm*—John C. Purdue

[57] ABSTRACT

An adjustable strap is disclosed, as is a combination of the strap with a boat. The strap comprises a ring, a longitudinally extending first fabric strip having cooperating "Velcro" portions for releasably locking a first end of the strip in each of a plurality of positions, a snap fastener and a longitudinally extending second fabric strip. The first strip has a free end which can pass through the ring and releasably engage an adjacent length of the strip to form a loop whose circumference varies. The second strip of fabric is attached to the first strip and to the snap fastener. The length of the second fabric strip is varied from strap to strap so that several of the straps are admirably suited to fasten a roll of a boat cover in a stowed condition to a boat having a plurality of snap fasteners positioned generally in aligned relationship with one another to engage cooperating fasteners on the cover.

2 Claims, 4 Drawing Figures

ADJUSTABLE STRAP

BACKGROUND OF THE INVENTION

1. Field of the Invention

This invention relates to an adjustable strap comprising a snap fastener and to a combination of a plurality of the adjustable straps with a boat. In the combination, the snap fasteners of the adjustable straps are engaged with cooperating snap fasteners on the boat and comprise a loop which surrounds and supports a roll of a boat cover, in a stowed condition. In a preferred embodiment, the strap is adjustable because it comprises a strip of a "Velcro" fabric, one end of which is attached to a ring and the other end of which, after passing through the ring, is operable to engage the "Velcro" strip at any of a plurality of longitudinal positions, and the snap fastener engages a fabric strip which is sewed or otherwise attached to the "Velcro" fabric strip, and can also be adjustable because it is capable of engaging the "Velcro" fabric strip at any of a plurality of positions.

2. THE PRIOR ART

A strap comprising a strip of "Velcro" fabric with one end attached to a ring, and adjustable because the other end is capable, after having been passed through the ring to form a loop, of engaging the strip on the other side of the ring at any of a plurality of longitudinal locations has previously been known. One embodiment of an adjustable strap according to the instant invention comprises such a strap with a length of fabric sewed, riveted, stapled or otherwise attached thereto and a snap fastener engaging the fabric. The structures of cooperating "Velcro" fabrics are disclosed in U.S. Pat. No. 2,717,437, granted Sept. 13, 1955 to Velcro S.A. of Switzerland, assignee.

OBJECTS OF THE INVENTION

It is an object of the instant invention to provide an improved adjustable strap.

It is a further object to provide an improved adjustable strap in combination with a boat.

Other objects and advantages will be apparent to those skilled in the art from the following description of preferred embodiments thereof, reference being made to the attached drawings.

DESCRIPTION OF PREFERRED EMBODIMENTS

Figure 1:
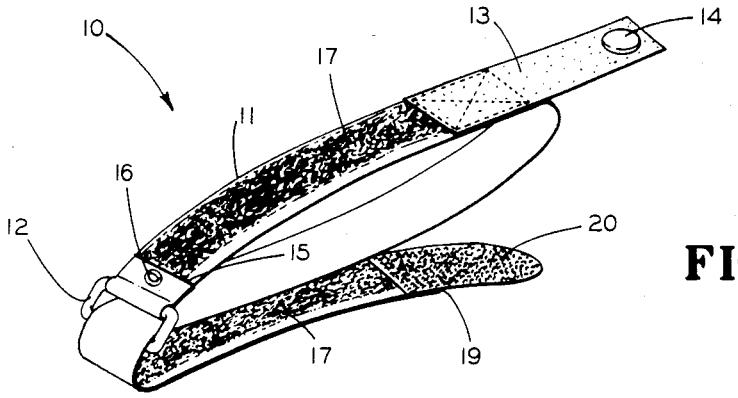
FIG. 1 is a perspective view of an adjustable strap according to the invention.
Figure 2:
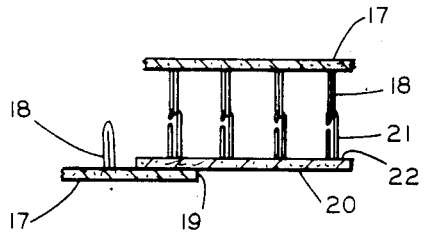
FIG. 2 is a fragmentary vertical sectional view showing two fabric parts of the strap of FIG. 1 releasably locked to one another.

An adjustable strap according to the instant invention is indicated generally at 10 in FIG. 1. The strap 10 comprises a strip 11 of "Velcro" fabric, a ring 12 and a strip 13 of fabric with a snap fastener 14 affixed thereto. An end 15 of the fabric strip 11 is doubled over, around the ring 12, and fastened by a rivet 16 to attach the ring 12 to the fabric strip 11. A side 17 of the fabric strip 11 has a plurality of closed loops 18 (see FIG. 2) extending therefrom. Adjacent an end 19 of the strip 11 a terminal portion 20 is glued or otherwise affixed thereto. The terminal portion 20 has cut loops 21 extending from a surface 22 so that the surfaces 17 and 20 are releasably locked to one another when brought into contact as shown in FIG. 2. This releasable locking can be at any of a plurality of longitudinal points relative to the surface 17, to vary the length of a loop (FIG. 1) which extends from the point where the fabric strip 11 is attached to the ring 12 to the point where that strip passes through the ring 12.

The fabric strip 13 is stitched, as indicated at 23, to the fabric strip 11 in the specific embodiment of the invention shown in FIG. 1. It will be appreciated, however, that this attachment could be accomplished by gluing, by riveting, or in any other desired manner.

Figure 3:
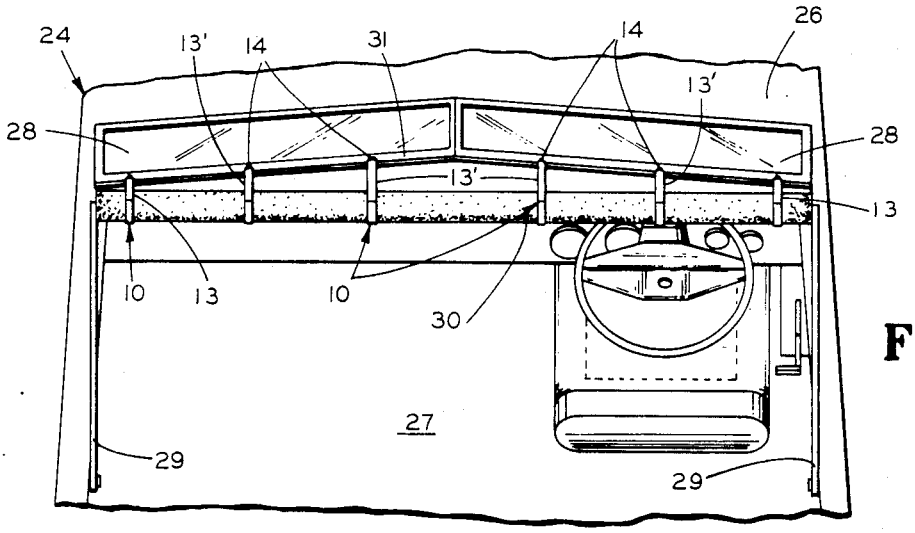
FIG. 3 is a fragmentary plan view showing the combination of a boat with a plurality of adjustable straps according to the invention.

A fragment of a boat indicated generally at 24 is shown in FIG. 3. The boat 24 comprises a hull 25, a forward deck 26, a cockpit 27 and a split windshield 28. A frame 29 for a boat cover 30 is pinned to the hull 25. The cover 30 is shown in a stowed condition, wrapped around a transverse member which is a part of the frame 29, and supported by a plurality of adjustable straps 10, 10' and 10'', which are identical except that the straps 10'' have fabric strips 13'' which are longer than the fabric strips 13, while the straps 10' have strips 13' of intermediate length, shorter than the strips 13'' and longer than the strips 13. The snap fasteners 14 of the straps 10, 10' and 10'' engage cooperating snap fasteners (not illustrated) which are mounted on an upper frame member 31 of the windshield 28. The cooperating snap fasteners which are mounted on the frame member 31 have heretofore been used to support an end of the cover 30 when it is not in a stowed condition, but is deployed to protect the boat 24 against the elements. It will be noted that the distance from the rolled cover 30 to the snap fasteners 14 (and to the cooperating fasteners which are attached to the frame member 31) varies from a minimum near the port and starboard sides of the boat 24 to a maximum near the center thereof. The straps 10, 10' and 10'', because of the differing lengths of the fabric strips 13, 13' and 13'', accommodate these different distances. Accordingly, each of the straps 10, 10' and 10'' can be set to engage the rolled cover 30 snugly and its snap 14 can then be engaged with the cooperating snap on the frame member 31.

Figure 4:
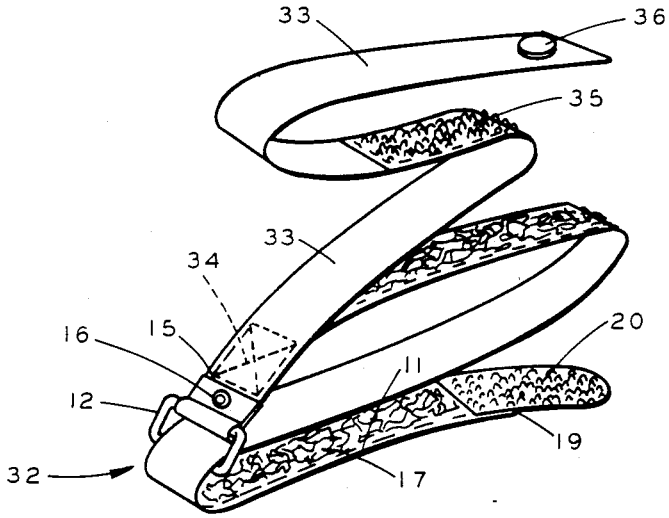
FIG. 4 is a perspective view of another embodiment of a strap according to the invention.

The effective length of the fabric strip 13 of the adjustable strap 10 can also be made variable. Such a strap, designated 32, is shown in FIG. 4. The strap 32 comprises the strip 11 of "Velcro" fabric and the ring 12. The end 15 of the fabric strip 11 is doubled over, around the ring 12, and fastened by the rivet 16. The side 17 of the fabric strip 11 has the plurality of closed loops 18 (see FIG. 2) extending therefrom, and the terminal portion 20, with its cut loops 21, is glued or otherwise affixed to the strip 11 adjacent the end 19.

The strap 32 also includes a fabric strip 33, stitched, as indicated at 34, to the fabric strip 11, and a cut-loop "Velcro" fabric 35 glued thereto for engagement at any desired position with the closed loops 18 of the side 17 of the strip 11. The "Velcro" fabric 35 makes the length of the strip 33 from the loop formed by the strip 11 to a snap fastener 36 affixed to the free end thereof variable. The stitching indicated at 34 prevents separation of the fabric strip 33 from the strip 11.

It will be apparent that various changes and modifications can be made from the specific details of the invention as disclosed herein without departing from the spirit and scope thereof as defined in the appended claims and that the invention comprises an adjustable strap and a combination of the adjustable strap with a boat. The strap comprises a longitudinally extending fabric strip, a ring, means attaching the fabric strip to the ring with an end and an adjacent length of the strip free of the ring, cooperating means operatively associated with the free end of the fabric strip for releasably locking the free end of the fabric strip in each of a plurality of longitudinal positions relative to the adjacent length of the strip which is free of the ring, a snap fastener, and a longitudinally extending second strip of fabric. The snap fastener is attached to the second strip of fabric, and the second strip of fabric is attached to the length of the first strip of fabric which is free of the ring. When the free end of the first strip and a part of the adjacent length of the strip which is free of the ring extend through the ring and the free end of the first strip is releasably locked to the adjacent end of the strip which is free of the ring, the first strip forms a loop whose circumference varies depending on the longitudinal position on the first strip at which the free end thereof is attached thereto. The combination comprises a boat having a plurality of snap fasteners positioned generally in aligned relationship with one another to engage cooperating fasteners on a cover for the boat, a roll of the boat cover, in a stowed condition, extending in a direction generally parallel to that in which the snap fasteners extend, and, in combination therewith, a plurality of adjustable straps as described above, the snap fasteners of each of the adjustable straps being engaged with one of the boat fasteners, and the free end of the first strip of each of the straps being releasably locked to the adjacent length of the strip which is free of the ring, forming a loop which surrounds and supports the roll of the boat cover. It will be appreciated that the snap fasteners of the boat can be attached to the windshield, as shown in FIG. 3, or can be attached to the stern or any other portion of the boat where it is desired to stow a roll of canvas or other gear. For example, the rolled cover could be separated from the frame 29 and stored along either the port or the starboard side of the boat, as could fishing rods or other gear.

I claim:

1. A boat having a plurality of snap fasteners positioned generally in aligned relationship with one another to engage cooperating fasteners on a cover for the boat, a roll of the boat cover, in a stowed condition, extending in a direction generally parallel to that in which said snap fasteners extend, and, in combination therewith, a plurality of adjustable straps, each of said straps comprising a ring, a longitudinally extending first strip of fabric, means attaching said fabric strip to said ring with an end and an adjacent length of said strip free of said ring, cooperating means operatively associated with said fabric strip for releasably locking the free end of said fabric strip in each of a plurality of longitudinal positions relative to the adjacent length of said strip which is free of said ring, a snap fastener, a longitudinally extending second strip of fabric, means attaching said snap fastener to said second strip of fabric, and means attaching said second strip of fabric to the length of said first strip of fabric which is free of said ring, whereby, when the free end of said first strip and a part of the adjacent length of said strip which is free of said ring extend through said ring and the free end of said first strip is releasably locked to the adjacent length of said strip which is free of said ring, said first strip forms a loop whose circumference varies, depending on the longitudinal position on said first strip at which the free end thereof is attached thereto, the snap fastener of each of said adjustable straps being engaged with one of said boat fasteners, and the free end of the first strip of each of said straps being releasably locked to the adjacent length of said strip which is free of said ring, forming a loop which surrounds and supports said roll of the boat cover.

2. A boat having a plurality of snap fasteners positioned generally in aligned relationship with one another, a longitudinally extending article to be stowed on the boat, and, in combination therewith, a plurality of adjustable straps, each of said straps comprising a ring, a longitudinally extending first strip of fabric, means attaching said fabric strip to said ring with an end and an adjacent length of said strip free of said ring, cooperating means operatively associated with said fabric strip for releasably locking the free end of said fabric strip in each of a plurality of longitudinal positions relative to the adjacent length of said strip which is free of said ring, a snap fastener, a longitudinally extending second strip of fabric, means attaching said snap fastener to said second strip of fabric, and means attaching said second strip of fabric to the length of said first strip of fabric which is free of said ring, whereby, when the free end of said first strip and a part of the adjacent length of said strip which is free of said ring extend through said ring and the free end of said first strip is releasably locked to the adjacent length of said strip which is free of said ring, said first strip forms a loop whose circumference varies, depending on the longitudinal position on said first strip at which the free end thereof is attached thereto, the snap fastener of each of said adjustable straps being engaged with one of said boat fasteners, and the free end of the first strip of each of said straps being releasably locked to the adjacent length of said strip which is free of said ring, forming a loop which surrounds and supports said article to be stowed on the boat.

* * * * *